US009346234B2

(12) United States Patent
Hajek et al.

(10) Patent No.: US 9,346,234 B2
(45) Date of Patent: May 24, 2016

(54) CARTON WITH LOCKING FEATURE

(71) Applicant: Graphic Packaging International, Inc., Atlanta, GA (US)

(72) Inventors: Ronald E. Hajek, Oak Lawn, IL (US); Bradley J. Burke, Glendale Heights, IL (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/471,283

(22) Filed: Aug. 28, 2014

(65) Prior Publication Data

US 2015/0060537 A1 Mar. 5, 2015

Related U.S. Application Data

(60) Provisional application No. 61/959,613, filed on Aug. 28, 2013.

(51) Int. Cl.

| | |
|---|---|
| ***B65D 5/54*** | (2006.01) |
| ***B31B 1/90*** | (2006.01) |
| ***B31B 1/26*** | (2006.01) |
| ***B65D 5/66*** | (2006.01) |
| ***B31B 1/25*** | (2006.01) |

(52) U.S. Cl.

CPC ... *B31B 1/90* (2013.01); *B31B 1/25* (2013.01); *B31B 1/26* (2013.01); *B65D 5/5425* (2013.01); *B65D 5/6608* (2013.01)

(58) Field of Classification Search

USPC ..... 229/242, 149; 493/49, 84, 137, 162

See application file for complete search history.

(56) References Cited

U.S. PATENT DOCUMENTS

| | | | |
|---|---|---|---|
| 1,772,625 | A | 8/1930 | Caulfield |
| 2,139,021 | A | 12/1938 | Johnson |
| 2,192,722 | A | 3/1940 | Vogt |
| 2,251,283 | A | 8/1941 | Johnson |
| 2,292,573 | A | 8/1942 | Kondolf |
| 2,335,913 | A | 12/1943 | Buttery |

(Continued)

FOREIGN PATENT DOCUMENTS

| | | |
|---|---|---|
| DE | 29 23 455 | 12/1980 |
| DE | 81 10 323.9 | 9/1981 |

(Continued)

OTHER PUBLICATIONS

International Search Report and Written Opinion for PCT/US2014/053079 dated Dec. 12, 2014.

*Primary Examiner* — Christopher Demeree

(74) *Attorney, Agent, or Firm* — Womble Carlyle Sandridge & Rice, LLP

(57) ABSTRACT

In one aspect, the disclosure is generally directed to a carton for holding at least one product. The carton includes a plurality of panels that extends at least partially around the interior of the carton. The plurality of panels includes a front panel, a top panel, and a lid panel foldably connected to the top panel. The carton includes a lid pivotably attached to the carton. The lid includes the lid panel and the top panel and is moveable between a closed position wherein the lid panels is positioned in face-to-face contact with the front panel and an open position allowing access to the interior of the carton. The carton includes locking features for releasably attaching the reclosable lid in the closed position. The locking features include at least one male locking portion in the front panel and at least one female locking portion in the lid panel.

34 Claims, 14 Drawing Sheets

(56) References Cited

U.S. PATENT DOCUMENTS

| | | | | |
|---|---|---|---|---|
| 2,337,892 | A | | 12/1943 | Hultin |
| 2,345,486 | A | | 3/1944 | Nathan |
| 2,355,665 | A | | 8/1944 | Mabee |
| 2,396,310 | A | | 3/1946 | Gibson |
| 2,437,926 | A | | 3/1948 | Ball et al. |
| 2,594,394 | A | | 4/1952 | Casselman et al. |
| 2,973,086 | A | | 2/1961 | Thompson |
| 3,013,712 | A | | 12/1961 | Wollaeger |
| 3,021,002 | A | | 2/1962 | Guyer |
| 3,033,362 | A | | 5/1962 | Marcalus |
| 3,180,556 | A | | 4/1965 | Asman |
| 3,355,089 | A | | 11/1967 | Champlin |
| 3,363,822 | A | | 1/1968 | Maulini et al. |
| 3,426,955 | A | | 2/1969 | Olson |
| 3,486,682 | A | | 12/1969 | Whipperman |
| 3,578,234 | A | | 5/1971 | Marchisen |
| 3,669,345 | A | | 6/1972 | Cole |
| 3,680,766 | A | | 8/1972 | Collura et al. |
| 3,690,544 | A | | 9/1972 | Meyers |
| 3,768,719 | A | | 10/1973 | Johnson |
| 4,262,816 | A | | 4/1981 | Margulies |
| 4,344,537 | A | | 8/1982 | Austin |
| 4,484,683 | A | | 11/1984 | Werner, Jr. |
| 4,508,218 | A | | 4/1985 | Focke et al. |
| 4,512,476 | A | | 4/1985 | Herrington, Jr. |
| 4,558,785 | A | | 12/1985 | Gordon |
| 4,572,423 | A | | 2/1986 | Spencer |
| 4,584,202 | A | | 4/1986 | Roccaforte |
| 4,621,736 | A | | 11/1986 | Roccaforte |
| 4,645,108 | A | | 2/1987 | Gavin et al. |
| 4,676,394 | A | | 6/1987 | Hiersteiner |
| 4,746,019 | A | | 5/1988 | Prater |
| 4,768,703 | A | | 9/1988 | Sosler et al. |
| 4,863,052 | A | | 9/1989 | Lambert |
| 4,905,898 | A | | 3/1990 | Wade |
| 4,948,038 | A | | 8/1990 | Moeller |
| 5,014,855 | A | * | 5/1991 | Roccaforte ..... 229/228 |
| 5,161,734 | A | * | 11/1992 | Ruehl et al. ..... 229/227 |
| 5,265,799 | A | | 11/1993 | Stone |
| 5,347,865 | A | | 9/1994 | Mulry et al. |
| 5,356,022 | A | | 10/1994 | Tipps |
| 5,363,981 | A | | 11/1994 | Giblin et al. |
| 5,373,960 | A | * | 12/1994 | Gunn et al. ..... 229/117.25 |
| 5,427,267 | A | | 6/1995 | Willman |
| 5,632,402 | A | | 5/1997 | Walsh et al. |
| 5,632,404 | A | | 5/1997 | Walsh |
| 5,746,871 | A | | 5/1998 | Walsh |
| 5,783,030 | A | | 7/1998 | Walsh |
| 5,794,811 | A | | 8/1998 | Walsh |
| 5,794,812 | A | | 8/1998 | Walsh |
| 5,857,614 | A | | 1/1999 | Walsh |
| 5,918,799 | A | | 7/1999 | Walsh |
| 5,960,555 | A | | 10/1999 | Deaton et al. |
| 5,996,797 | A | | 12/1999 | Flaig |
| 6,102,277 | A | | 8/2000 | Krapohl, Sr. |
| 6,352,096 | B1 | | 3/2002 | Walsh |
| 6,364,202 | B1 | | 4/2002 | Zelley |
| 6,520,404 | B1 | | 2/2003 | Waldburger et al. |
| 6,568,586 | B1 | | 5/2003 | VanEsley et al. |
| 6,761,269 | B2 | | 7/2004 | Hamming |
| 6,854,639 | B2 | | 2/2005 | Walsh |
| 6,869,009 | B2 | | 3/2005 | Sutherland et al. |
| 7,025,504 | B2 | | 4/2006 | Olin |
| 7,407,087 | B2 | | 8/2008 | DeBusk et al. |
| 7,699,214 | B2 | | 4/2010 | Mestre et al. |
| 7,703,665 | B2 | | 4/2010 | McGowan |
| 8,002,171 | B2 | | 8/2011 | Ryan et al. |
| 2001/0048022 | A1 | | 12/2001 | Zoeckler |
| 2002/0036153 | A1 | | 3/2002 | Yang |
| 2002/0055429 | A1 | | 5/2002 | Walsh |
| 2003/0144121 | A1 | | 7/2003 | Walsh et al. |
| 2004/0007614 | A1 | | 1/2004 | Saulas |
| 2004/0226989 | A1 | | 11/2004 | Cook et al. |
| 2005/0109827 | A1 | | 5/2005 | Martin |
| 2005/0187087 | A1 | | 8/2005 | Walsh |
| 2006/0049067 | A1 | | 3/2006 | McDonald |
| 2006/0243783 | A1 | | 11/2006 | Spivey, Sr. et al. |
| 2006/0255105 | A1 | | 11/2006 | Sweet |
| 2006/0255107 | A1 | | 11/2006 | Wright |
| 2006/0266810 | A1 | | 11/2006 | Foushee |
| 2009/0001145 | A1 | | 1/2009 | Hasse et al. |
| 2013/0193197 | A1 | | 8/2013 | Low et al. |

FOREIGN PATENT DOCUMENTS

| | | | |
|---|---|---|---|
| DE | 87 08 078.8 | | 10/1987 |
| DE | 94 13 813 | | 10/1994 |
| EP | 0 406 556 | | 1/1991 |
| EP | 1 457 425 | | 9/2004 |
| FR | 2 699 150 | | 6/1994 |
| FR | 2 755 670 | | 5/1998 |
| GB | 104 445 | | 3/1917 |
| GB | 1 242 356 | | 8/1971 |
| GB | 1 489 963 | | 10/1977 |
| GB | 1 584 066 | | 2/1981 |
| GB | 2 137 172 | A | 10/1984 |
| GB | 2 363 372 | | 12/2001 |
| JP | 06-037127 | U | 5/1994 |
| JP | 08-268426 | A | 10/1996 |
| JP | 2010-0184713 | A | 8/2010 |
| JP | 2011-084279 | A | 4/2011 |
| KR | 20-0332055 | Y1 | 11/2003 |
| KR | 10-2008-0114121 | A | 12/2008 |
| WO | WO 95/28325 | | 10/1995 |
| WO | WO 2006/133401 | | 12/2006 |

* cited by examiner

CARTON WITH LOCKING FEATURE

CROSS-REFERENCE TO RELATED APPLICATIONS

This application claims the benefit of U.S. Provisional Patent Application No. 61/959,613, filed Aug. 28, 2013.

INCORPORATION BY REFERENCE

The disclosure of U.S. Provisional Patent Application No. 61/959,613, which was filed on Aug. 28, 2013, is hereby incorporated by reference for all purposes as if presented herein in its entirety.

BACKGROUND OF THE DISCLOSURE

The present invention generally relates to packages or cartons for holding and dispensing one or more products, such as food products. More specifically, the present disclosure relates to cartons with reclosable locking features.

SUMMARY OF THE DISCLOSURE

In one aspect, the disclosure is generally directed to a carton for holding and dispensing at least one product. The carton comprises a plurality of panels that extends at least partially around the interior of the carton. The plurality of panels comprises a front panel, a top panel, and a lid panel foldably connected to the top panel. The carton includes a lid pivotably attached to the carton. The lid comprises the lid panel and the top panel and is moveable between a closed position wherein the lid panels is positioned in face-to-face contact with the front panel and an open position allowing access to the interior of the carton. The carton includes locking features for releasably attaching the reclosable lid in the closed position preventing access to the interior of the carton. The locking features comprise at least one male locking portion in the front panel and at least one female locking portion in the lid panel. The locking features being releasably engaged in the closed position to allow the lid to be pivoted to the open position.

In another aspect, the disclosure is generally directed to a blank for forming a carton for holding and dispensing at least one product. The blank comprises a plurality of panels. The plurality of panels comprises a front panel, a top panel, and a lid panel foldably connected to the top panel. The blank further comprises lid features for forming a lid. The lid features comprises the lid panel and the top panel. The blank further comprises locking features. The locking features comprise at least one male locking portion in the front panel and at least one female locking portion in the lid panel. The locking features are configured for being releasably engaged in the closed position to allow the lid to be pivoted to the open position when the blank is formed into a carton.

In another aspect, the disclosure is generally directed to a method of forming a carton for holding and dispensing at least one product. The method comprises obtaining a blank comprising a plurality of panels. The plurality of panels comprises a front panel, a top panel, and a lid panel foldably connected to the top panel. The blank further includes lid features for forming a lid. The lid features comprises the lid panel and the top panel. The blank further includes locking features comprising at least one male locking portion in the front panel and at least one female locking portion in the lid panel. The method comprises forming an interior of the carton at least partially defined by the plurality of panels. The method further comprises forming the reclosable lid by positioning the lid panel in face-to-face contact with the front panel and engaging the male locking portion with the female locking portion.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure relates generally to various aspects of materials, blanks, packages, cartons, constructs, etc., for holding food items, and methods of making such materials, blanks, packages, cartons, and constructs. Although several different disclosures, aspects, implementations, and embodiments are provided, numerous interrelationships between, combinations thereof, and modifications of the various disclosures, aspects, implementations, and embodiments are contemplated hereby. In this specification, the terms "lower," "bottom," "upper," "top," "front," and "back," or other terms of orientation, indicate orientations determined in relation to fully erected cartons or packages and any such indication of orientations is not intended to limit the scope of the disclosure as the cartons or packages disclosed herein are capable of different orientations than shown and/or described herein.

Figure 1:
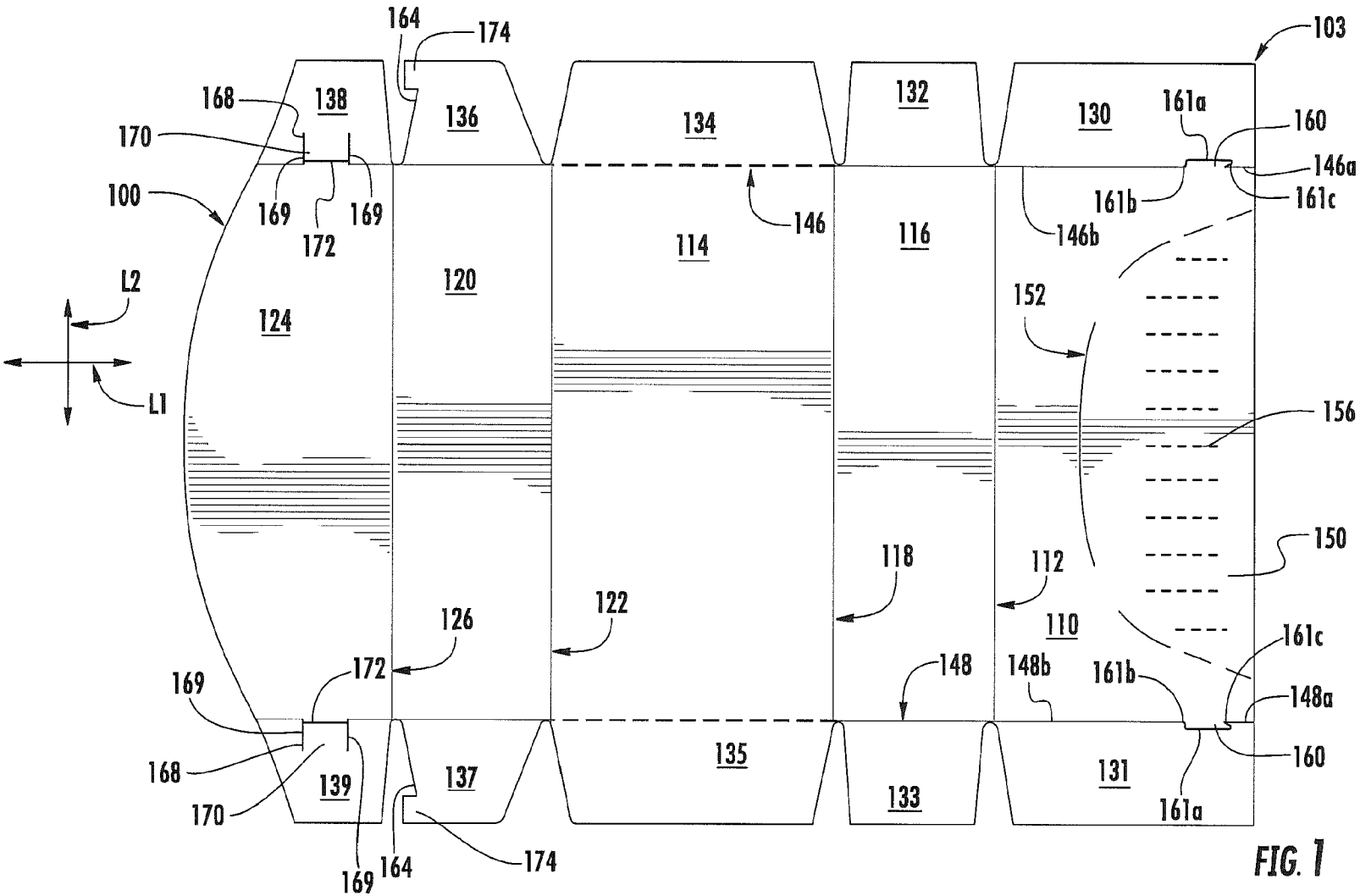
FIG. 1 is plan view of exterior surface of a blank.
Figure 6A:
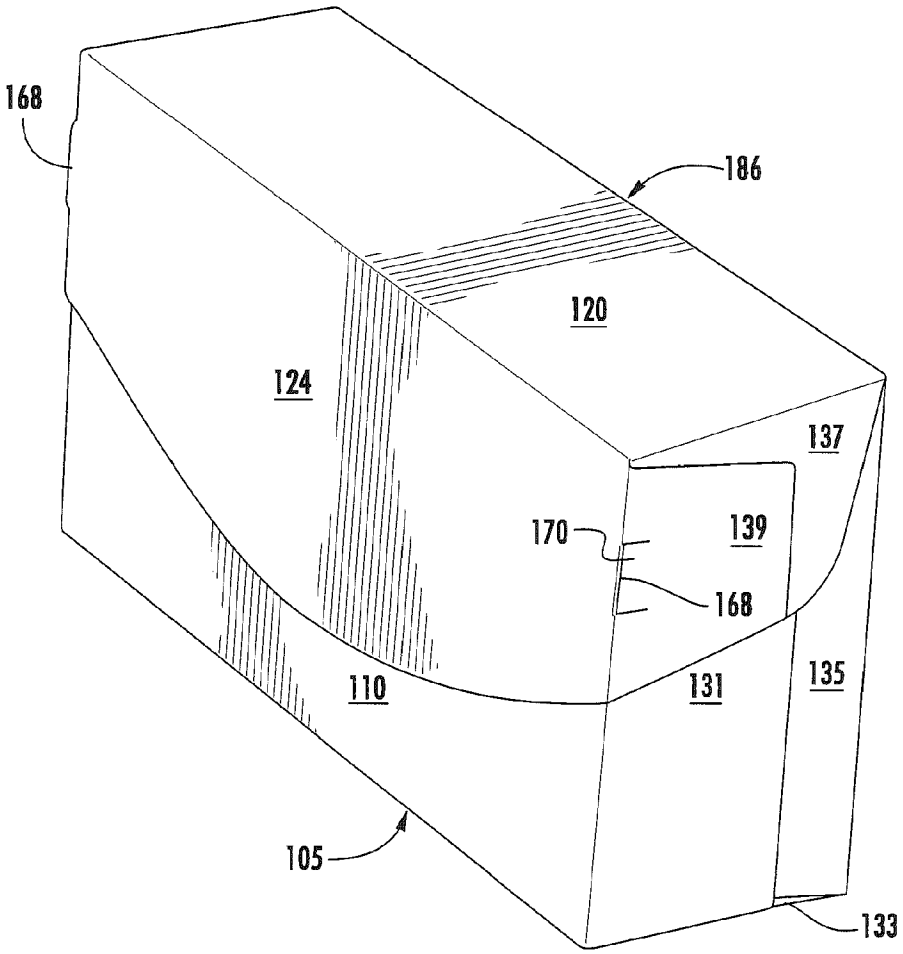
FIGS. 6A and 6B are perspective views of the carton fully assembled.
Figure 13:
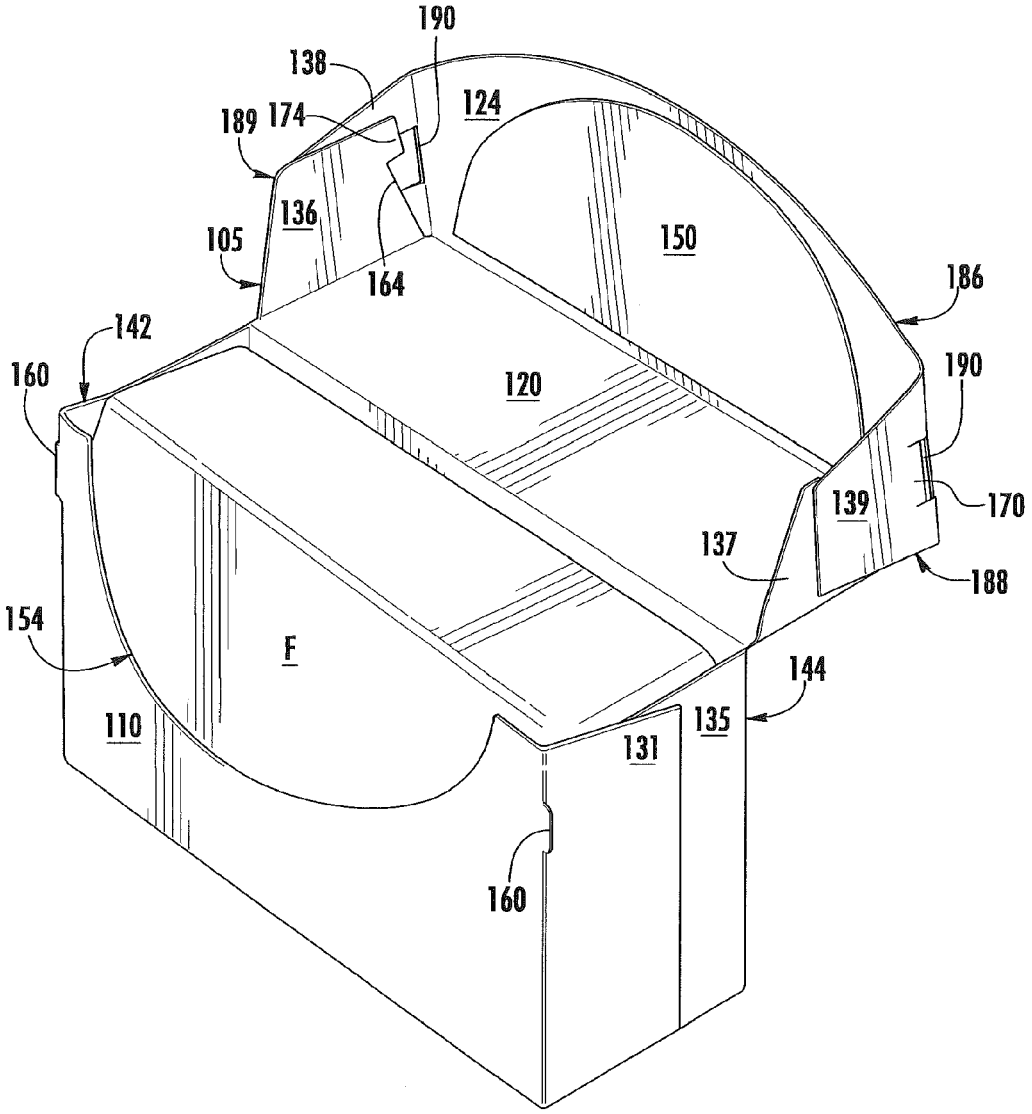
FIG. 13 is a top perspective view of the interior of the carton of FIG. 6.

FIG. 1 shows an exterior surface 100 of a blank 103 for forming a carton 105 (FIGS. 6A and 13). In one embodiment, the carton 105 may be useful for holding one or more food products F such as dairy products (e.g., cheese, cream cheese, butter, etc.) or one or more nonfood products, or any other suitable article that may be placed in the carton 105 for service to a customer. The products can be contained in additional packaging and then placed in the carton 105. The carton 105 can include various dispensing features and various opening/closing features. The carton 105 has a reclosable lid 186 that has various locking and engagement features as described below. The carton 105 could be otherwise shaped and arranged and could be used to hold other food products in other environments without departing from the disclosure.

As shown in FIG. 1, the blank 103 has a longitudinal axis L1 extending generally in the direction of the length of the blank and a lateral axis L2 extending generally in the direction of the width of the blank. In one embodiment, the blank 103 comprises a front panel 110, a bottom panel 116 foldably connected to the front panel 110 at a lateral fold line 112, a back panel 114 foldably connected to the bottom panel 116 at a lateral fold line 118, a top panel 120 foldably connected to the back panel 114 at a lateral fold line 122, and a lid panel 124 foldably connected to the top panel 120 at a lateral fold line 126.

Figure 5:
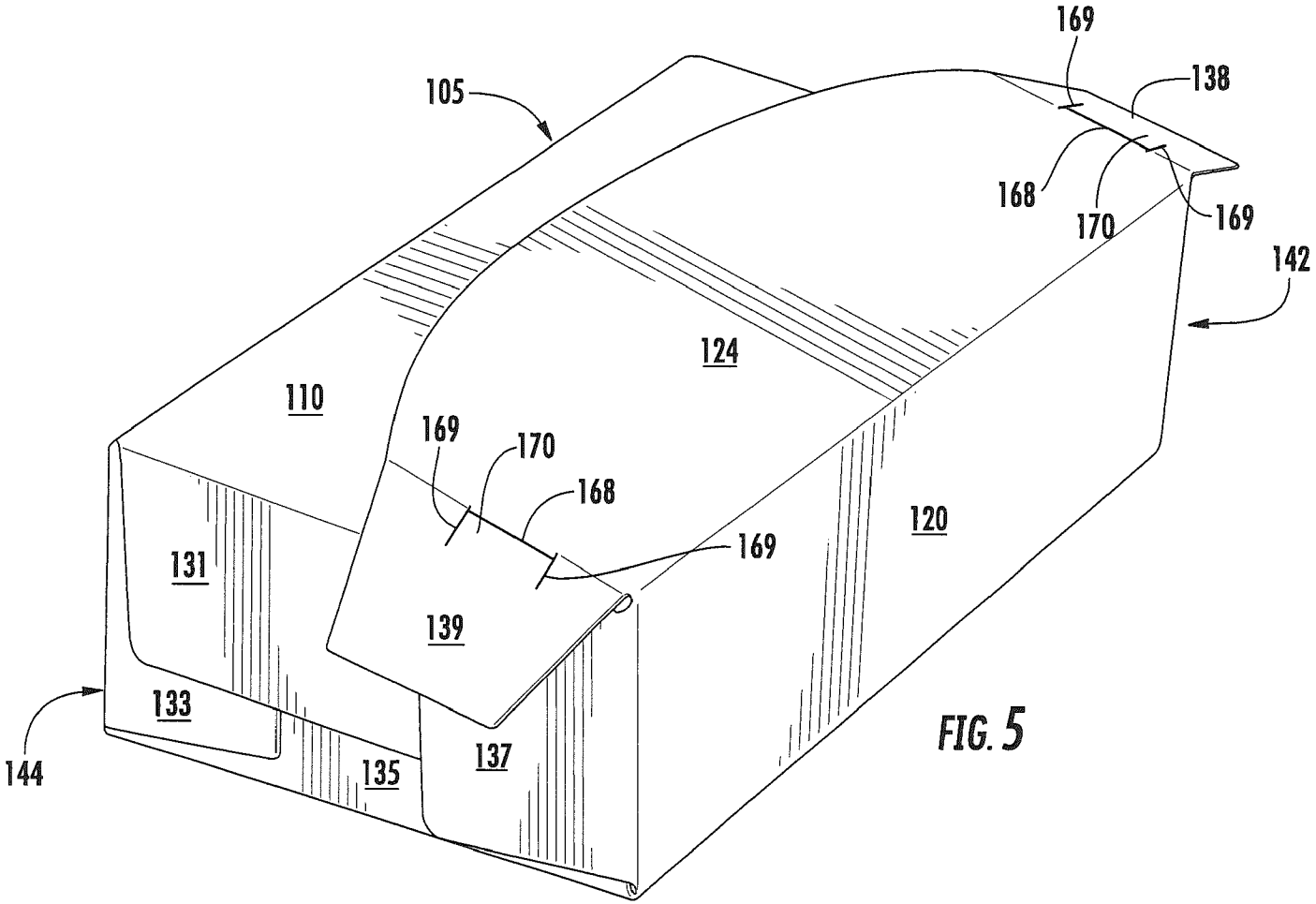

In one embodiment, the front panel 110 is foldably connected to a first end flap 130 and a second end flap 131. The bottom panel 116 is foldably connected to a first end flap 132 and a second end flap 133. The back panel 114 is foldably connected to a first end flap 134 and a second end flap 135. The top panel 120 is foldably connected to a first end flap 136 and a second end flap 137. The lid panel 124 is foldably connected to a first end flap 138 and a second end flap 139. As illustrated in FIG. 5, when the carton 105 is erected, the end flaps 130, 132, 134, 136, 138 close the first end 142 of the carton 105, and the end flaps 131, 133, 135, 137, 139 close the second end 144 of the carton 105. In accordance with an alternative embodiment of the present disclosure, different flaps arrangements can be used for closing the ends 142, 144 of the carton 105. For example, end flaps 132, 133 could be folded inward after the upward folding of end flaps 134, 135 shown in FIG. 3. Alternatively, the end flaps 134, 135 could be folded after the end flaps 132, 133 shown in FIG. 6A, and/or the end flaps 136, 137 could be folded prior to end flaps 134, 135, so that the end flaps 134, 135 are in an overlapping relationship with the end flaps 136, 137.

In the illustrated embodiment, the end flaps 130, 132, 134, 136, 138 extend along a first marginal area of the blank 103, and are foldably connected at a first longitudinal fold line 146 that extends along the length of the blank 103. The end flaps 131, 133, 135, 137, 139 extend along a second marginal area of the blank 103, and are foldably connected at a second longitudinal fold line 148 that also extends along the length of the blank 103. The longitudinal fold lines 146, 148 may be for example, substantially straight, decoratively curved, or offset at one or more locations to account for blank thickness or for other factors.

Figure 2:
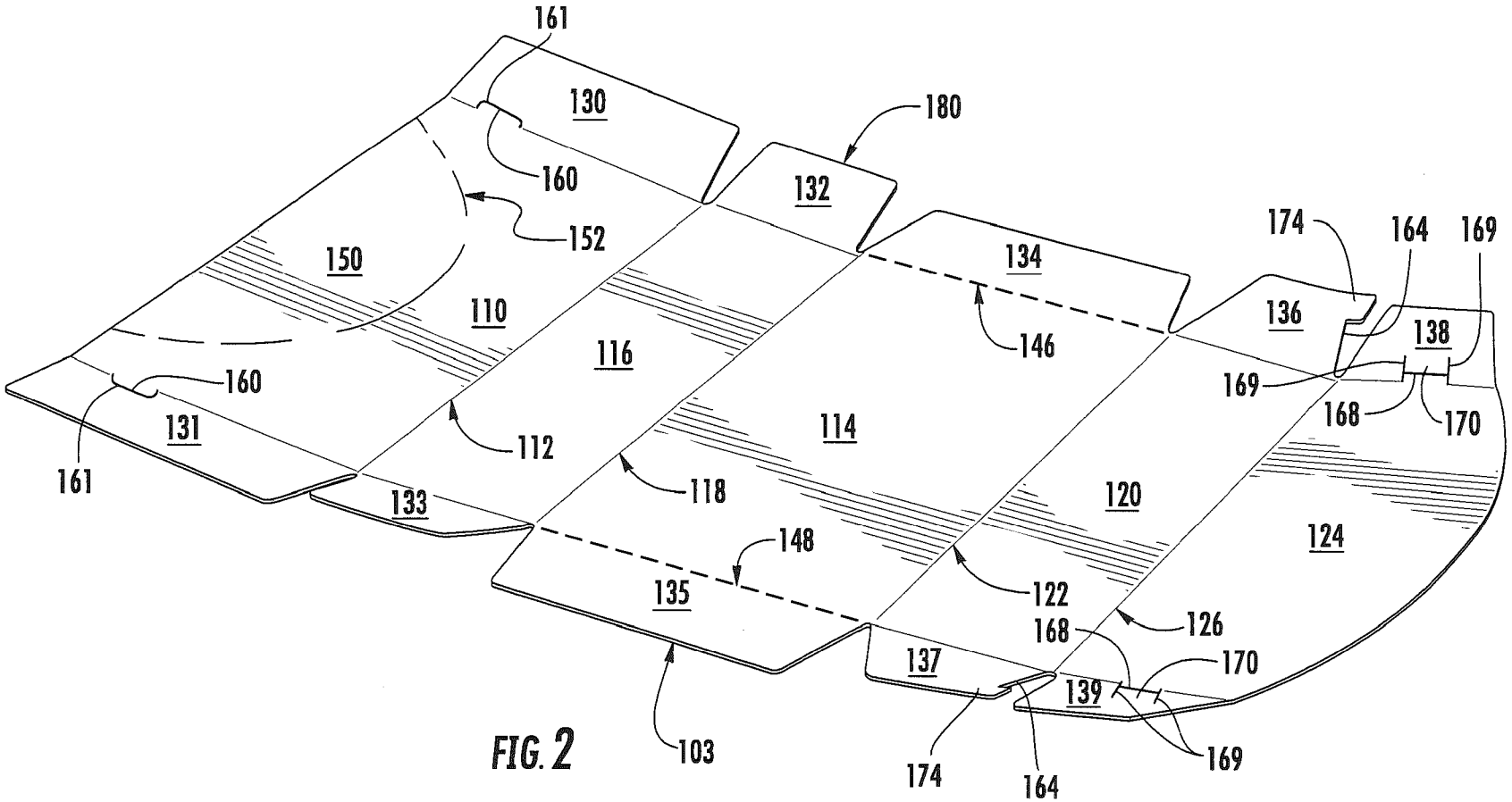
FIG. 2 is top perspective view of the interior surface of FIG. 1.

As shown in FIGS. 1 and 2, the front panel 110 includes an access panel 150 removably attached along a curved tear line 152. The tear line 152 can be, for example but not limited to, a single tear line, multiple segmented tear lines, a series of cut lines, or spaced apart slits. In one embodiment, access panel 150 comprises a portion of an edge of the front panel 110. Further, the access panel 150 may have several rows of longitudinal partial cuts 156 on the exterior. The partial cuts 156 create a surface that assist with the adhesion of glue when the carton is formed. The access panel 150 can be otherwise shaped, arranged, and/or positioned without departing from the disclosure. Alternatively, the access panel 150 could be omitted from the front panel 110 without departing from the disclosure, with the lid panel 124 and the front panel 110 being releasably attached by suitable means (i.e., releasable adhesive, glue release areas, tear strip at marginal portion of lid panel 124 and adhesively secured to front panel 110, etc.). Further, the tear line 152 can be omitted or can be a series of one or more straight tear lines without departing from the disclosure.

As shown in FIGS. 1-4, the blank comprises locking features including locking tabs 160 (male locking portions) extending from the front panel 110, notches 164 and tabs 174 in end flaps 136, 137, and H-shaped slits 168 (female locking portions) in the end flaps 138, 139. As discussed in more detail below, the H-shaped slits 168 form an opening 190 (FIG. 6B) and respective flaps 170 in respective end flaps 138, 139, with the opening 190 being formed as a result of the folding of a respective flap 170.

In one embodiment, each of the tabs 160 is defined by a cut 161 extending between respective portions 146*a*, 146*b*, 148*a*, 148*b* of the longitudinal fold lines 146, 148. In one embodiment the cut 161 includes a lateral portion 161*a* and two curved end portions 161*b*, 161*c* that extend from a respective portion 146*a*, 146*b*, 148*a*, 148*b* of the fold lines 146, 148. The cut 161 and the tab 160 could be otherwise shaped, arranged, and/or configured without departing from the scope of the disclosure.

As shown in FIGS. 1-5, the H-shaped slits 168 are defined by two lateral cuts 169 extending from respective portions of the longitudinal fold lines 146, 148 and a longitudinal cut 172 extending between the lateral cuts 169. The H-shaped slits 168 form a foldable flap 170 in respective end flaps 138, 139. In one embodiment, the longitudinal cut 172 is offset from a respective fold line 146, 148 to create a panel 170 that allows the locking tab 160 to rest on the panel 170 when the blank is formed into a carton. The H-shaped slits 168, the lateral cuts 169, the longitudinal cut 172, and the flaps 170 could be otherwise shaped, arranged, and/or configured without departing from the disclosure.

As shown in FIG. 1, the end flaps 136, 137 connected to the top panel 120 have respective notches 164 that are adjacent tabs 174 that extend outward at the distal edge of the end flaps 136, 137 toward end flaps 138, 139. In one embodiment the notches 164 are formed by an oblique edge of a respective end flap 136, 137 that extends from a respective fold line 146, 148 for the tab 174 at a distal end of a respective end flap 136, 137. The notches 164 and/or tabs 174 could be otherwise shaped, arranged, and/or configured without department from the disclosure. Further, the tabs 174 and/or notches 164 could be omitted without departing from the disclosure. The tabs 174 provided additional locking support by engaging tabs 160 in the closed/locked configuration of the lid 186.

Figure 3:
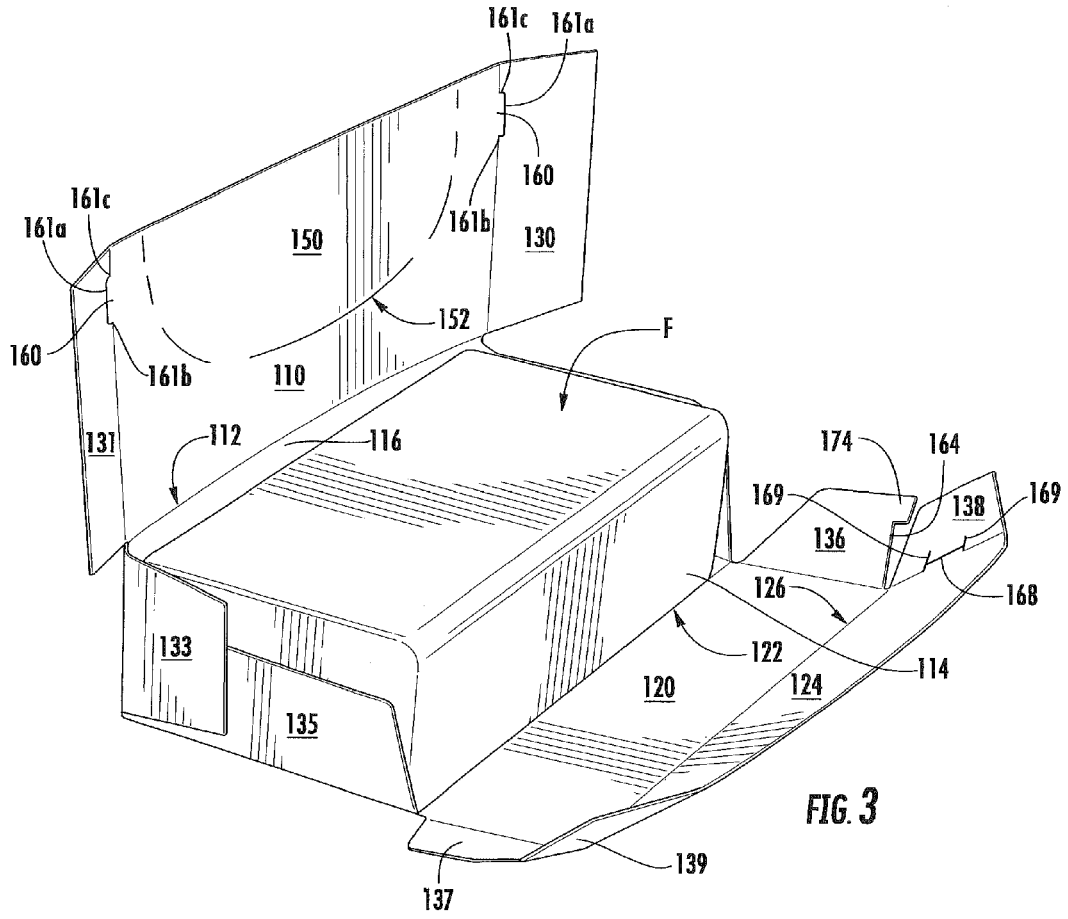
FIGS. 3-5 are perspective views of the interior of the carton partially formed.
Figure 4:
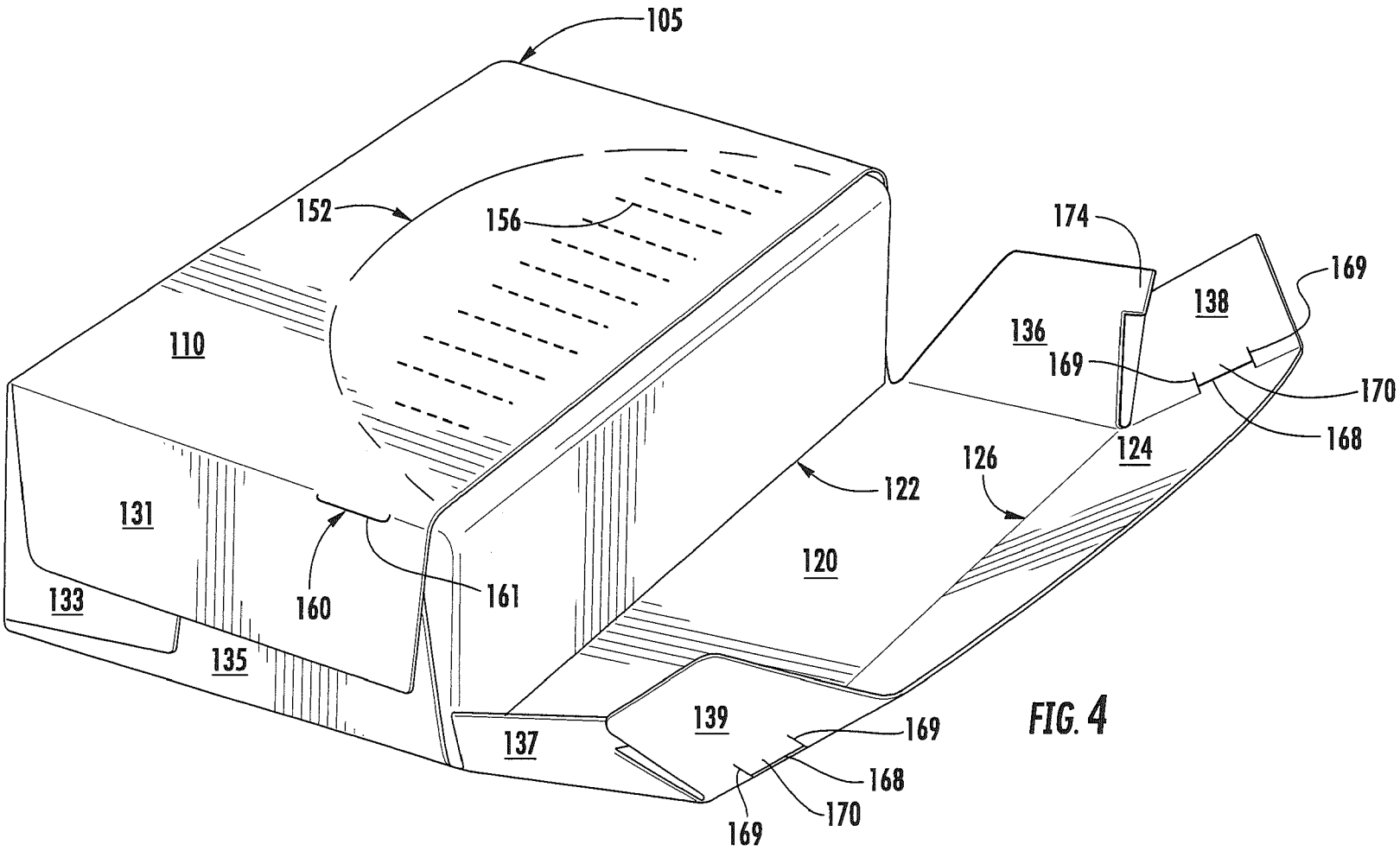

In one exemplary method of forming the blank 103 into the carton 105, the blank 103 is first placed with the interior surface 180 facing up as illustrated in FIG. 2. At least one product F is placed on the back panel 114. Prior to or after placing the product F on the back panel 114, the bottom panel 116 and end flaps 134, 135 can be upwardly folded relative to the back panel 114 as illustrated in FIG. 3. Alternatively, the top panel 120 can be folded upwardly to a position parallel to bottom panel 116 to form a tray that receives the product F. As shown in FIG. 4, the front panel 110 and end flaps 130, 131 can be folded downwardly relative to the bottom panel 116. The end flaps 130, 132, 134 can be positioned to at least partially overlap to close the first end 142 and the end flaps 131, 133, 135 can be positioned to at least partially overlap to close the second end 144. The top panel 120, as illustrated in FIG. 5, can be upwardly folded relative to the bottom panel 116 along lateral fold line 122 and the lid panel 124 can be downwardly folded relative to the top panel 120 along lateral fold line 126. The end flaps 138, 139 can be positioned on the outside of and partially overlap with end flaps 136, 137, respectively to form a closed corner of the reclosable lid 186. The lid panel 124 can at least partially overlap the front panel 110 and can be adhesively attached to the exterior surface of the access panel 150. Alternatively, the top panel 120 can be upwardly folded at fold lien 122 prior to the downwardly folding of the front panel 110 at fold line 112, end flaps 136, 137 being folded inwardly prior to the end flaps 130, 31 so that the end flaps 130, 131 overlap and retain the end flaps 136, 137, and end flaps 138, 139 can be at least partially adhered to the end flaps 130, 131. Other folding sequences or configurations could be used without departing from the scope of the disclosure.

When the blank 103 is formed into a carton 105 the locking tabs 160 extend outwardly from the front panel 110 when the end flaps 130, 131 are folded to close the carton 105. When the end flaps 138, 139 connected to the lid panel 124 are folded to close the carton 105, openings 190 are formed in the end flaps and the locking tabs 160 engage the openings 190 and/or tabs 174 to create a releasable lock. The flaps 170 can flex outward and provide added space for the locking tabs 160 when the blank 103 is formed into a carton 105. The configuration of the flaps 170 that are formed by the offset of cut 172 being spaced apart from the fold line 146, 148 provides clearance for receiving the locking tab 160 during formation of the carton 105 and positioning during opening and closing of the lid 186.

Figure 12:
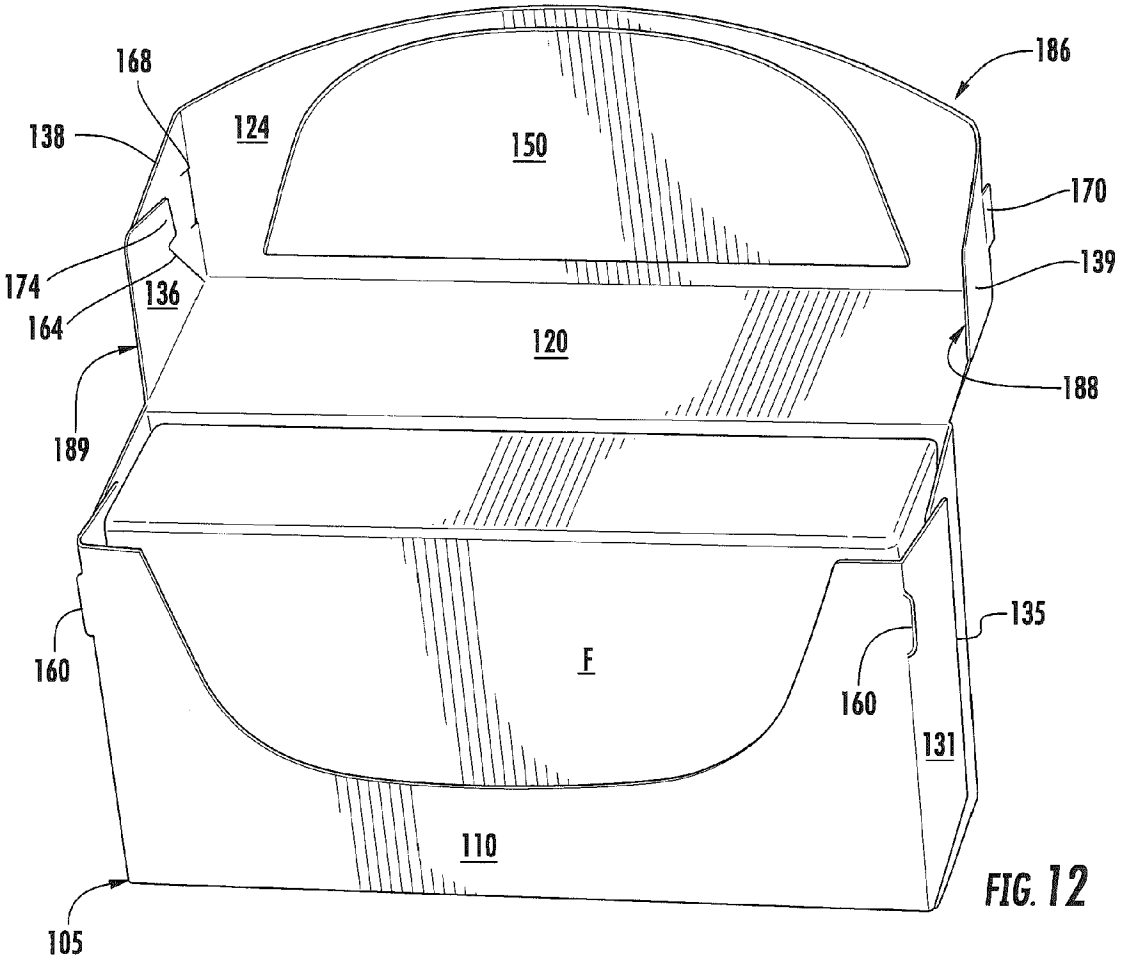
FIG. 12 is a front perspective view of the carton of FIG. 6 in the open configuration.

As illustrated in FIGS. 12 and 13, the reclosable lid 186 comprises the top panel 120, the lid panel 124, the access panel 150 attached to the lid panel 124, and end flaps 136, 137, 138, 139 with respective locking features 170, 190. The reclosable lid 186 is hingedly connected to the back panel 114 along fold lateral fold line 122. The reclosable lid 186 is positionable in an open position wherein the releasable lock is disengaged allowing access to the interior of the carton 105 and a closed position wherein the lid panel 124 is positioned in face-to-face contact with the front panel 110 preventing access to the interior of the carton 105. When reclosable lid 186 is in the closed position, the locking tabs 160 extending from the front panel 110 engage flaps 170 of end flaps 136, 137 to hold the lid in the closed position. Alternatively, the locking tabs 160 also may engage the tabs 174 without departing from the spirit of the disclosure.

In one exemplary method of initially opening the carton 105, the lid panel 124 is upwardly pulled separating the access panel 150 from the front panel 110 along tear line 152. After the access panel 150 separates from the front panel 110, the access panel 150 remains connected to the lid panel 124 and moves upwardly with the lid panel 124 when the lid 186 is moved to the open position, as illustrated in FIGS. 12-13. Alternatively, the lid panel 124 could be releasably attached to the front panel 110 by other features (e.g., tear strip adhered to front panel 110 and separable from the lid panel 124, etc.) without departing from the disclosure.

Figure 6B:
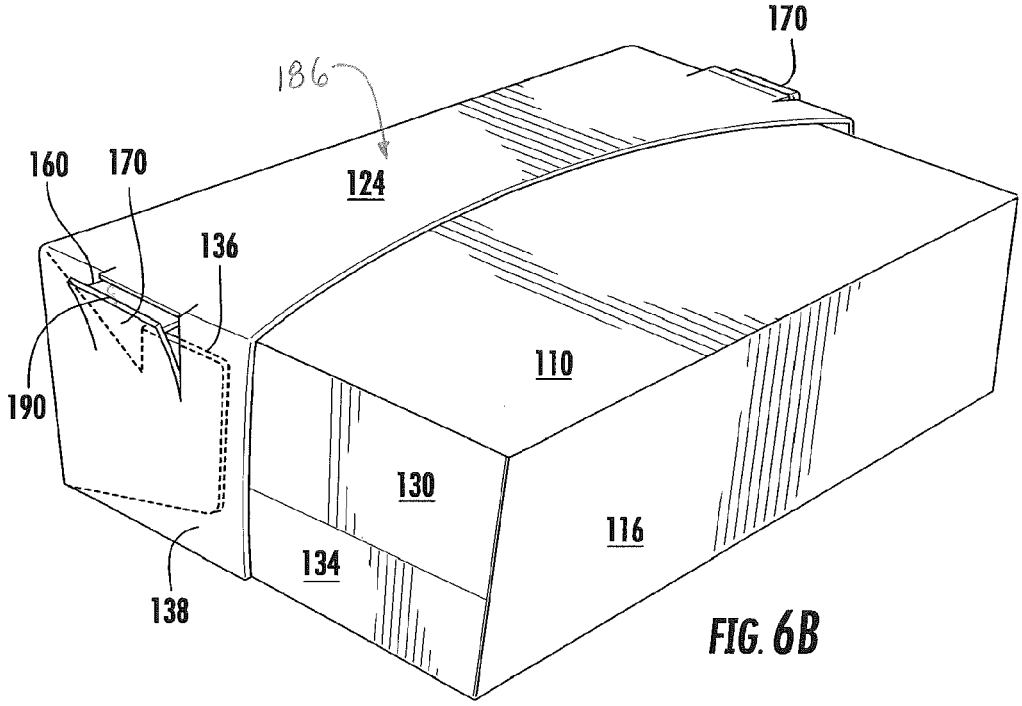
Figure 6C:
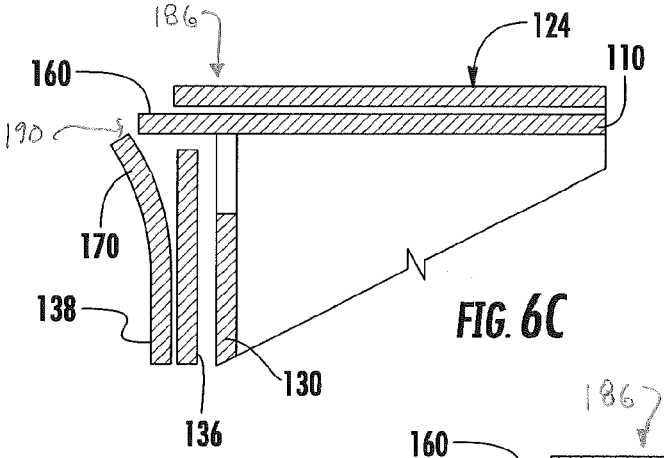
FIGS. 6C and 6D are cross-sectional views of a corner of the carton.
Figure 6D:
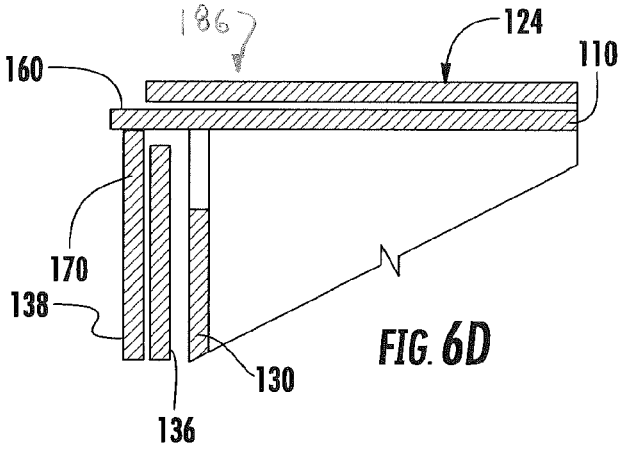
Figure 7:
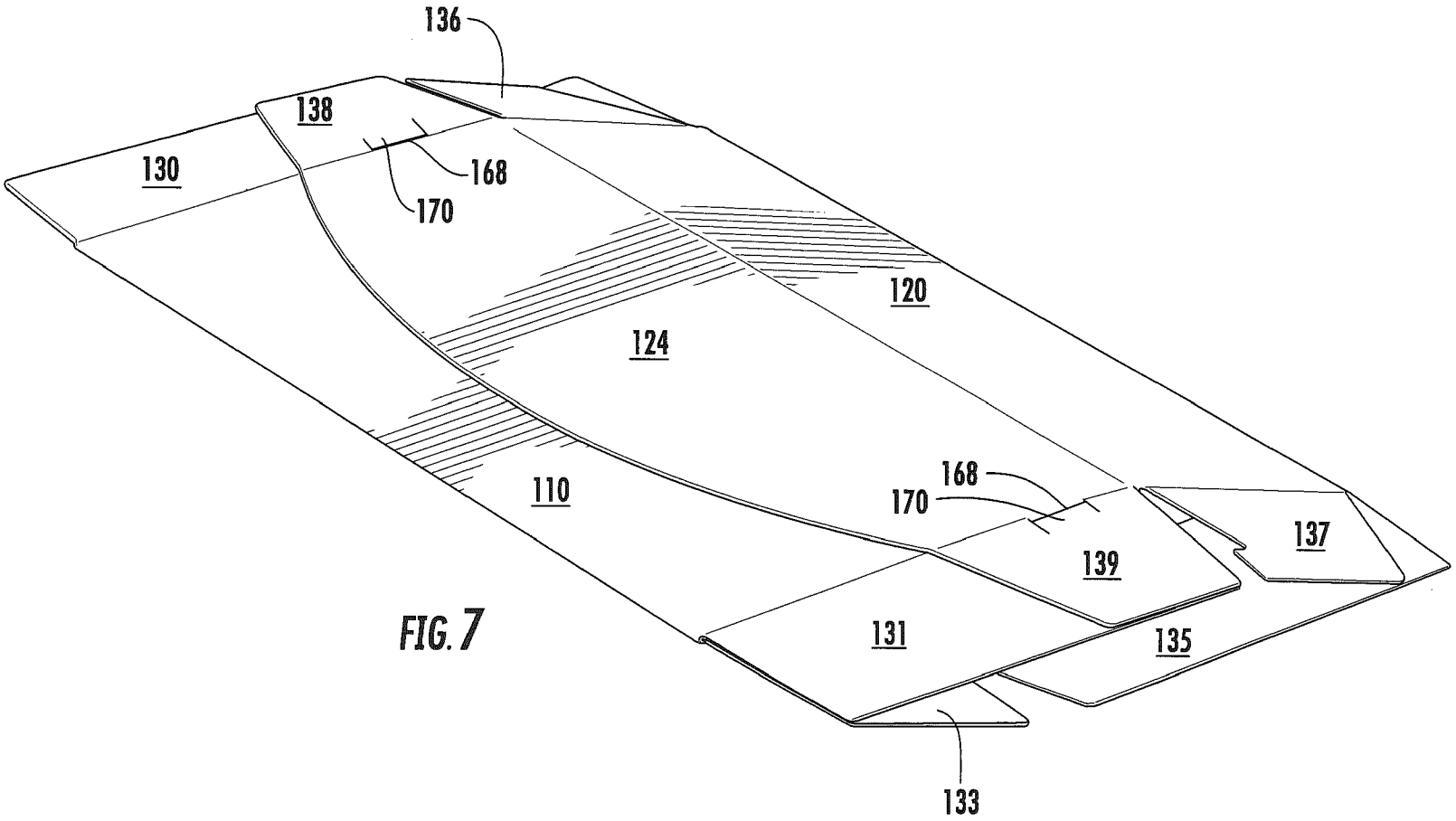
FIG. 7 is a perspective view of the blank of FIG. 1 formed into a sleeve.

The carton 105 may be reclosed by positioning the reclosable lid 186 in the closed position by folding the lid 186 downwardly such that the flaps 170 in the end flaps 138, 139 are brought into engagement with locking tabs 160 extending from the front panel 110. As the flaps 170 and tabs 174 slide past the locking tabs 160 an audible click is produced to provide feedback to the user that the locking features of the lid 186 are engaged. The foldable flaps 170 created by the 'H' style slits in the end flaps 138, 139 of the lid 186 also flex outwardly extending the opening 190 to provide added space to accommodate the locking tabs 160 without deformation to the audible lock position wherein the tabs 160 are located above tabs 174 and closely adjacent lid panel 124. FIGS. 6B and 6C show the lid in a position where the tabs 174 having already cleared the locking tabs 160 and the flaps being flexed outwardly by the engagement of the tabs 160 just prior to fully closing the lid 186 in a locked and secured position. FIG. 6D shows the fully closed configuration of the lid 186 with the tabs 174 of the end flaps 136 and the flaps 170 secured below the tabs 160 so the lid 186 is prevented from raising without disengaging the tabs 174 and/or flaps 170 from the tabs 160.

When an opening force is applied to the center of the reclosable lid 186, the sides of the lid 186 flex inwardly, as shown in FIGS. 6B and 6C, forcing the locking tabs 160 engaged with the end flaps 136, 137 to protrude outward through the opening 190 of H-shaped slits 168. As forces increase the opening 190 allow more surface area under surface of the locking tabs 160 to be engaged by the flaps 170 of the end flaps 136, 137.

To open the reclosable lid 186 and prevent the locking force increase, the opening force may be applied to any area substantially off center, such as the edges 188, 189 of the lid 186. If the lid 186 is attempted to be opened by applying a force near the center of the carton 105, the sides of the lid corresponding to overlapped flaps 136, 138 and 137, 139 would flex inwardly resulting in inward movement of the flap 170 and displacement of the locking tabs 160 through the opening 190 and an increase in the locking force resisting the opening of the lid (FIG. 6D). By applying the opening force off center, the sides of the lid 186 flex outwardly allowing the notch 164 and the tab 174 to clear the locking tabs 160 and the lid to be raised. Further, an audible click may be produced as the tabs 174 disengage the locking tabs 160 when the carton 105 is opened.

Figure 8:
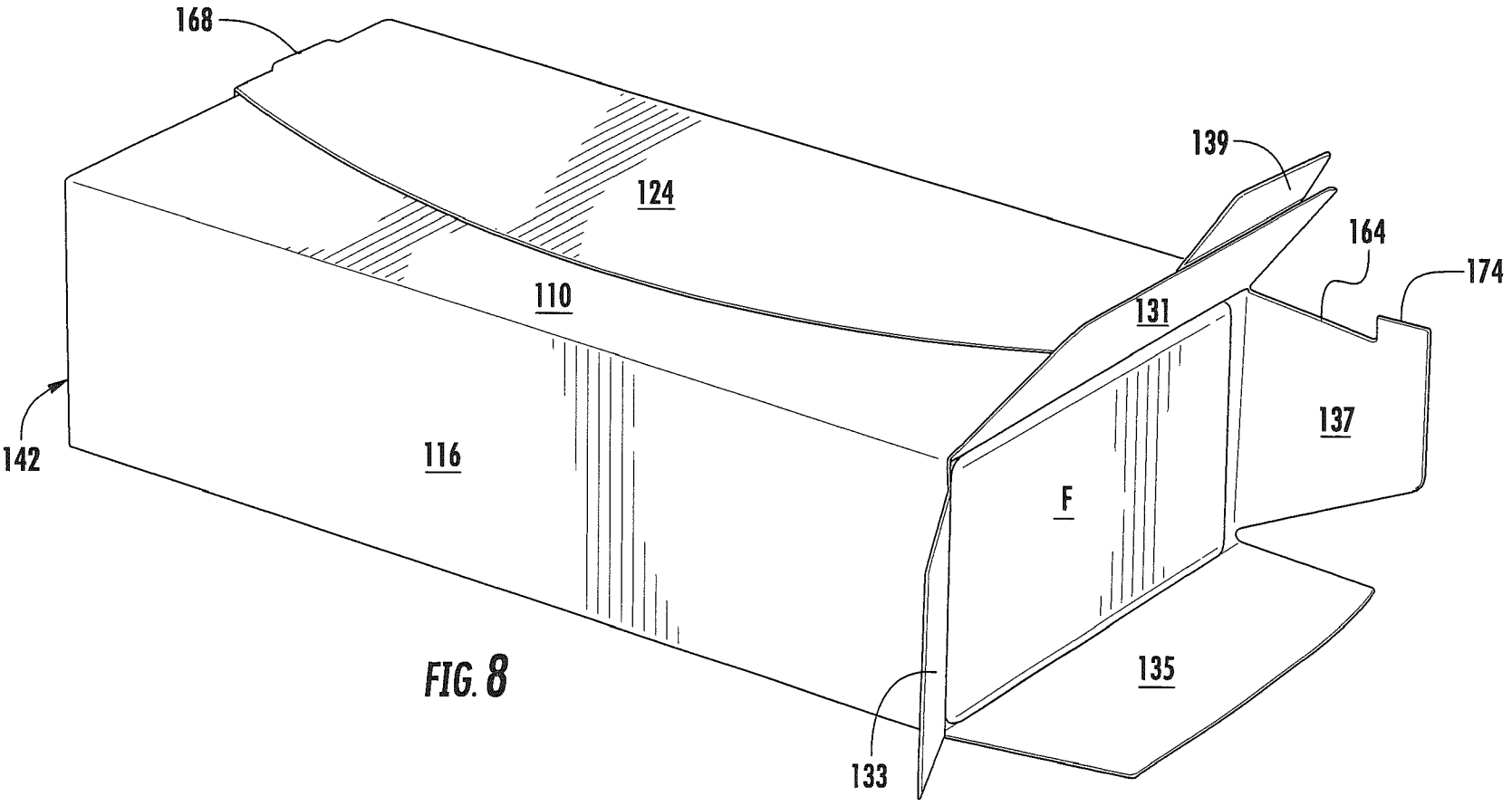
FIG. 8 is a perspective view of the carton being formed from the blank of FIG. 1.

The carton 105 can be formed, closed, and/or opened by other alternative methods and steps without departing from the disclosure. As illustrated in FIGS. 7-11, in one alternative method, the panels 110, 114, 116, 120, 124 can be positioned to form an open-end sleeve as shown in FIG. 8, with the product F being loaded into the open-ended sleeve prior to closing one or both ends 142, 144 of the carton 105.

Figure 9:
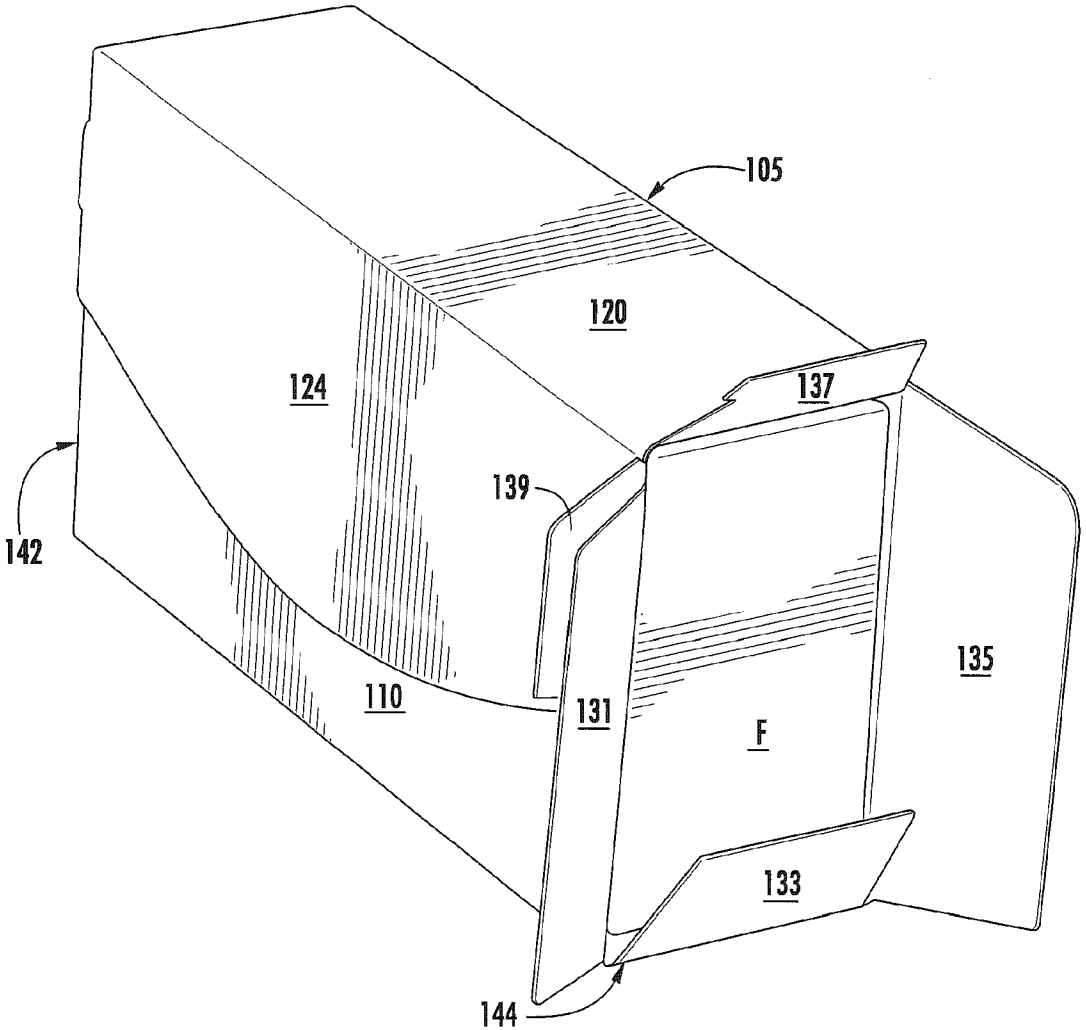
FIG. 9-11 are side perspective views of the carton being formed from the blank of FIG. 1.
Figure 10:
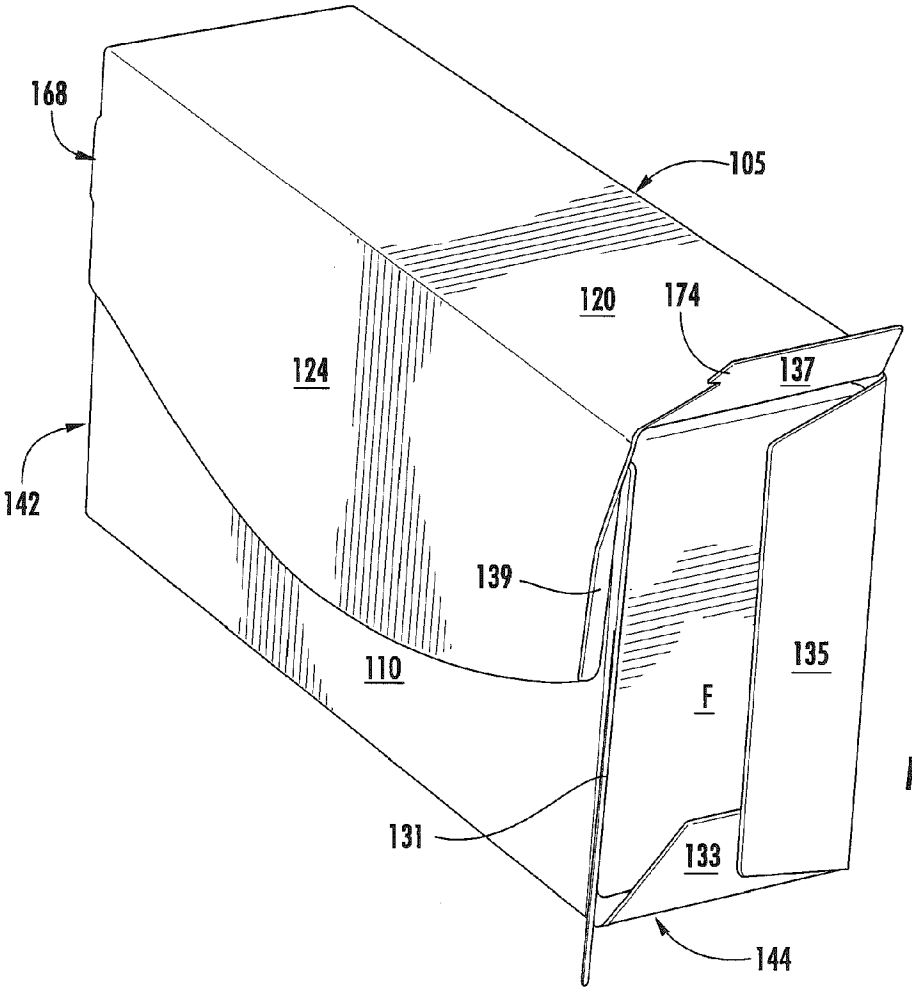
Figure 11:
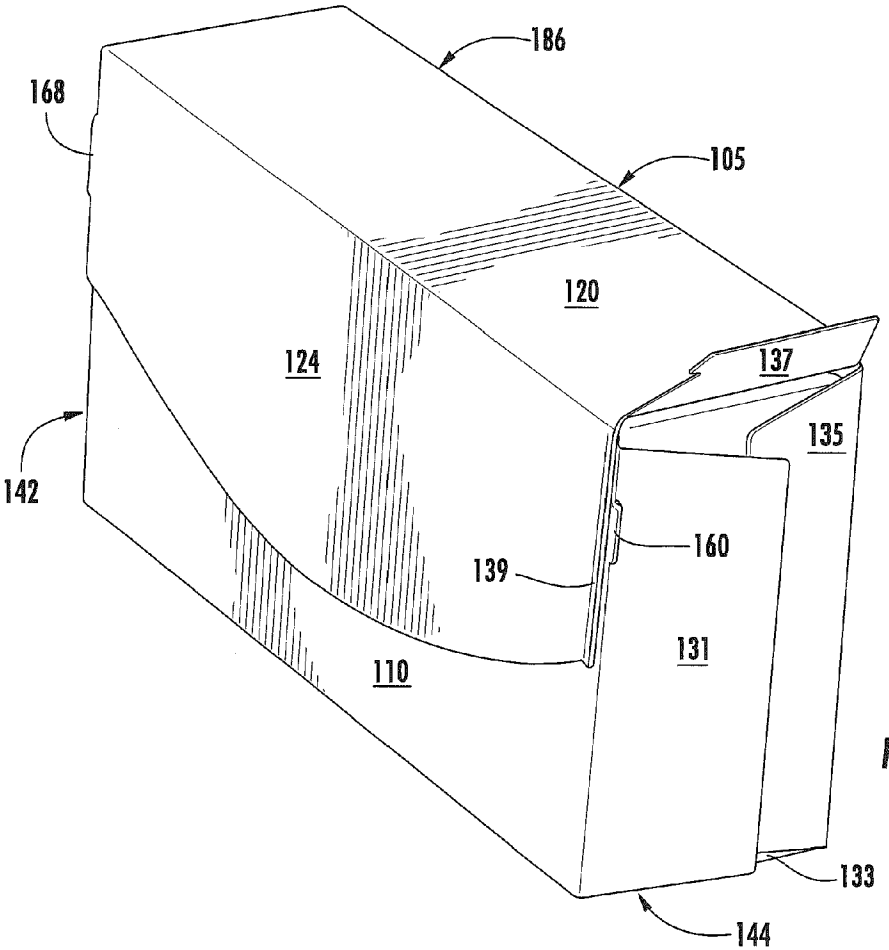

As illustrated in FIGS. 9-11, the second end 144 can be closed by first folding end flap 133 upward relative to the bottom panel 116. As shown in FIG. 10, the end flap 135 is folded inwardly relative to the back panel 114 to at least partially overlap the end flap 133. Alternatively, the end flap 135 could be folded inwardly prior to folding the end flap 133 to overlap the end flap 135. End flap 131 is then folded inwardly relative to the front panel 110 to at least partially overlap end flaps 133 and 135 to close the bottom portion of the carton 105 as illustrated in FIG. 11. The second side of the reclosable lid 186 is closed by first folding end flap 137 downwardly relative to the top panel 120 and end flap 139 is folded inwardly relative to the lid panel 124 to partially overlap the end flap 137 and close the second side of the reclosable lid and the second end 144 of the carton 105. The end flaps 130, 132, 134, 136, 138 of the first side 142 may be closed similarly to the corresponding end flaps 131, 133, 135, 137, 139 of the second side 144. Alternatively, end flap 134 could be folded inwardly prior to folding the end flap 132 to overlap the end flap 134. Alternatively, an open-ended tray could be formed by panels 110, 114, 116 so that panel 116 is oriented on the bottom and end flaps 130, 131, 132, 133, 134, 135 close ends of the tray, with the tray receiving the product and then being closed by positioning panels 120, 124 and end flaps 136, 137, 138, 139 to close and form the carton 105. Other tray or loading configurations could be provided without departing from the disclosure.

In an alternative embodiment, one or more of end flaps 130, 131, 134, 135 could have a cut-away portion to allow adhesive applied to one or more of end flaps 136, 137 to contact end flaps 138, 139 via the cut-away portions. The end flaps 130, 131, 132, 133, 134, 135, 136, 137, 138, 139 could be otherwise shaped, arranged, positioned and/or configured without departing from the disclosure. For example, end flaps 136, 137 could be folded under end flaps 134, 135 and be adhered to end flaps 139, 139 in an alternative closing arrangement.

In general, the blank may be constructed from paperboard having a caliper so that it is heavier and more rigid than ordinary paper. The blank can also be constructed of other materials, such as cardboard, sheet plastics or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carton panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding and dispensing at least one product, the carton comprises:

a plurality of panels that extends at least partially around the interior of the carton, the plurality of panels comprise a front panel, a top panel, and a lid panel foldably connected to the top panel;

a lid pivotably attached to the carton, the lid comprises the lid panel and the top panel and is moveable between a closed position wherein the lid panel is positioned in face-to-face contact with the front panel and an open position allowing access to the interior of the carton;

locking features for releasably attaching the reclosable lid in the closed position preventing access to the interior of the carton, the locking features comprise at least one male locking portion in the front panel and at least one female locking portion in the lid, the locking features being releasably engaged in the closed position to allow the lid to be pivoted to the open position; and a plurality of end flaps for closing an end of the carton, the plurality of end flaps comprises a first end flap foldably connected to the front panel and a second end flap foldably connected to the lid panel, the male locking portion is defined by features in the first end flap and the female locking portion is defined by features in the second end flap, and the female locking portion comprises an opening and a foldable flap foldably connected to the second end flap adjacent the opening, the foldable flap is foldable relative to the second end flap to releasably engage the male locking portion.

2. The carton of claim 1, wherein the male locking portion comprises a locking tab in the front panel that is defined by at least one cut in the first end flap.

3. The carton of claim 2, wherein the opening comprises at least one cut in the second end flap.

4. The carton of claim 3, wherein the foldable flap is formed by the at least one cut that comprises a first lateral cut, a second lateral cut, and a longitudinal cut extending between the first lateral cut and the second lateral cut.

5. The carton of claim 4, wherein the longitudinal cut is spaced inward from the respective ends of the first lateral cut and second lateral cut to from and H-shaped cut forming the foldable flap.

6. The carton of claim 2, wherein the locking tab extends outwardly from the front panel into the opening and releasably engages the foldable flap of the female locking portion in the closed position of the lid.

7. The carton of claim 2, wherein the plurality of end flaps comprises a third end flap foldably connected to the top panel, the third end flap comprises a notch and a tab at a distal end of the third end flap.

8. The carton of claim 7, wherein the reclosable lid comprises the lid panel, the top panel, the second end flap, and the third end flap.

9. The carton of claim 8, wherein the plurality of panels comprises a back panel foldably connected to the top panel and a bottom panel foldably connected to the back panel and the front panel, the reclosable lid is pivotably attached to the back panel at a fold line.

10. The carton of claim 7, wherein the tab of the third end flap engages the locking tab of the front panel to hold the lid in the closed position.

11. The carton of claim 1, wherein an access panel is removably attached to the front panel along a first tear line, the lid panel is positioned in face-to-face contact with the access panel in the closed position of the lid.

12. The carton of claim 11, wherein the plurality of panels comprises a back panel foldably connected to the top panel and a bottom panel foldably connected to the front panel and the back panel, the reclosable lid is pivotably attached to the back panel at a fold line.

13. The carton of claim 1, wherein the plurality of end flaps is a first plurality of end flaps and the end is a first end, the at least one male locking feature is a first male locking feature, and the at least one female locking portion is a first female locking portion, the carton comprises a second plurality of end flaps closing a second end of the carton, a second male locking feature, and a second female locking portion.

14. A blank for forming a carton for holding and dispensing at least one product, the blank comprises:

a plurality of panels, the plurality of panels comprise a front panel, a top panel, and a lid panel foldably connected to the top panel;

lid features for forming a lid, the lid features comprises the lid panel and the top panel;

locking features comprising at least one male locking portion in the front panel and at least one female locking portion in the lid panel, the locking features are configured for being releasably engaged in the closed position to allow the lid to be pivoted to the open position when the blank is formed into a carton; and a plurality of end flaps for closing an end of the carton when the blank is formed into a carton, the plurality of end flaps comprises a first end flap foldably connected to the front panel and a second end flap foldably connected to the lid panel, the male locking portion is defined by features in the first end flap and the female locking portion is defined by features in the second end flap, and the female locking portion comprises an opening and a foldable flap foldably connected to the second end flap adjacent the opening, the foldable flap is foldable relative to the second end flap to releasably engage the male locking portion in the carton formed from the blank.

15. The blank of claim 14, wherein the male locking portion comprises a locking tab in the front panel that is defined by at least one cut in the first end flap.

16. The blank of claim 15, wherein the opening comprises at least one cut in the second end flap.

17. The blank of claim 16, wherein the foldably flap is formed by the at least one cut that comprises a first lateral cut, a second lateral cut, and a longitudinal cut extending between the first lateral cut and the second lateral cut.

18. The blank of claim 15, wherein the locking tab is configured to extend outwardly from the front panel into the opening and releasably engage the foldable flap of the female locking portion in the closed position of the lid when the blank is formed into a carton.

19. The blank of claim 14, wherein the plurality of end flaps comprises a third end flap foldably connected to the top panel, the third end flap comprises a notch and a tab at a distal end of the third end flap.

20. The blank of claim 19, wherein the lid features comprises the lid panel, the top panel, the second end flap, and the third end flap.

21. The blank of claim 20, wherein the plurality of panels comprises a back panel foldably connected to the top panel and a bottom panel foldably connected to the back panel and the front panel.

22. The blank of claim 14, wherein an access panel is removably attached to the front panel along a first tear line, the lid panel is for being positioned in face-to-face contact with the access panel in the closed position of the lid when the blank is formed into a carton.

23. The blank of claim 22, wherein the plurality of panels comprises a back panel foldably connected to the top panel and a bottom panel foldably connected to the front panel and the back panel.

24. The blank of claim 14, wherein the plurality of end flaps is a first plurality of end flaps and the end is a first end, the at least one male locking feature is a first male locking feature, and the at least one female locking portion is a first female locking portion, the blank comprises a second plurality of end flaps, a second male locking feature, and a second female locking portion.

25. A method of forming a carton for holding and dispensing at least one product, the method comprises:

obtaining a blank comprising a plurality of panels, the plurality of panels comprise a front panel, a top panel, and a lid panel foldably connected to the top panel; lid features for forming a lid, the lid features comprises the lid panel and the top panel; locking features comprising at least one male locking portion in the front panel and at least one female locking portion in the lid panel; and a plurality of end flaps, the plurality of end flaps comprises a first end flap foldably connected to the front panel and a second end flap foldably connected to the lid panel, the male locking portion is defined by features in the first end flap and the female locking portion is defined by features in the second end flap, and the female locking portion comprises an opening and a foldable flap foldably connected to the second end flap adjacent the opening;

forming an interior of the carton at least partially defined by the plurality of panels;

forming the reclosable lid by positioning the lid panel in face-to-face contact with the front panel; and engaging the male locking portion with the female locking portion, the engaging comprises folding the foldably flap relative to the second end flap to releasably engage the male locking portion.

26. The method of claim 25, wherein an access panel is removably attached to the front panel along a first tear line, and the method further comprises positioning the lid panel in face-to-face contact with the access panel.

27. The method of claim 26, wherein the male locking portion comprises a locking tab in the front panel that is defined by at least one cut in the first end flap; and the opening comprises at least one cut in the second end flap.

28. The method of claim 27, wherein the at least one cut comprises a first lateral cut, a second lateral cut, and a longitudinal cut extending between the first lateral cut and the second lateral cut.

29. The method of claim 27, the method further comprises separating the reclosable lid by tearing the access panel along the first tear line accessing the interior of the carton and pivoting the lid to the open position.

30. The method of claim 29, wherein the method further comprises reclosing the carton by pivoting the reclosable lid to the closed position, and engaging the locking extending from the front panel with the foldable flap and the opening.

31. The method of claim 30, wherein the plurality of end flaps further comprise a third end flap foldably connected to the top panel, the third end flap comprises a notch and a tab at a distal end of the third flap; and the reclosable lid comprises the lid panel, the top panel, the second end flap, and the third end flap.

32. The method of claim 31, wherein the plurality of panels comprises a back panel foldably connected to the top panel and a bottom panel foldably connected to the back panel and the front panel.

33. The method of claim 30, wherein an audible click is produced when the foldable flap passes the locking tab and the locking tab engages the opening as the lid is pivoted to the closed position.

34. The method of claim 27, wherein the plurality of end flaps is a first plurality of end flaps and the end is a first end, the at least one male locking feature is a first male locking feature, and the at least one female locking portion is a first female locking portion, the carton comprises a second plurality of end flaps closing a second end of the carton, a second male locking feature, and a second female locking portion.

* * * * *